US006128847A

United States Patent [19]

Langner

[11] Patent Number: 6,128,847

[45] Date of Patent: Oct. 10, 2000

[54] WEAPON DISCHARGE SAFETY MECHANISM

[76] Inventor: F. Richard Langner, P.O. Box 14706, Scottsdale, Ariz. 85267

[21] Appl. No.: 09/153,394

[22] Filed: Sep. 15, 1998

[51] Int. Cl.[7] ..... F41A 17/00; G01L 5/14

[52] U.S. Cl. ..... 42/106; 73/167; 42/70.07; 42/70.11; 42/77

[58] Field of Search ..... 73/167; 273/404; 42/70.07, 106, 90, 75.01, 77

[56] References Cited

U.S. PATENT DOCUMENTS

| | | | |
|---|---|---|---|
| 2,080,202 | 5/1937 | Drake | 42/70.07 |
| 2,882,636 | 4/1959 | Shinaver | 42/70.07 |
| 3,066,433 | 12/1962 | Roger et al. | 42/70.07 |
| 3,372,641 | 3/1968 | Foster | 102/65 |
| 3,704,536 | 12/1972 | Kratt | 42/1 |
| 3,713,239 | 1/1973 | Sperling | 42/1 |
| 3,727,455 | 4/1973 | Boder | 73/167 |
| 3,940,981 | 3/1976 | Covey et al. | 73/167 |
| 3,956,844 | 5/1976 | Misevich et al. | 42/90 |
| 4,326,468 | 4/1982 | King et al. | 109/49.5 |
| 4,483,190 | 11/1984 | Cornett | 73/167 |
| 4,945,665 | 8/1990 | Nelson | 42/70.07 |
| 4,961,277 | 10/1990 | Rosenbaum | 42/70.11 |
| 5,033,218 | 7/1991 | Nelson | 42/70.07 |
| 5,044,106 | 9/1991 | Slocum | 42/70.11 |
| 5,140,893 | 8/1992 | Leiter | 89/14.5 |
| 5,371,965 | 12/1994 | Nelson | 42/70.07 |
| 5,377,438 | 1/1995 | Sheinfeld et al. | 42/96 |
| 5,574,245 | 11/1996 | Buc et al. | 102/485 |
| 5,631,438 | 5/1997 | Martel | 89/14.3 |
| 5,699,687 | 12/1997 | Pittman | 70/376 |
| 5,724,760 | 3/1998 | Langner | 42/70.07 |
| 5,927,578 | 7/1999 | Kay | 224/224 |
| 6,032,396 | 3/2000 | Shapiro | 42/70.06 |

*Primary Examiner*—Michael J. Carone
*Assistant Examiner*—Denise J Buckley
*Attorney, Agent, or Firm*—LaValle D. Ptak

[57] ABSTRACT

A weapon discharge safety mechanism is designed in one multiple section piece for use with handguns and in two separate sections for use with rifles. The discharge safety mechanism includes a trigger guard housing with a bottom, first and second sides and an open top, which fits over and covers the trigger guard and trigger area of a firearm such as a pistol or a rifle. The trigger guard housing portion is releasably secured by a retention pin just behind the front of the trigger guard to hold the trigger guard housing portion in place covering the trigger guard. For handguns, an enclosed bullet trap housing is attached to the trigger guard housing portion. For rifles, this housing is separate. The bullet trap housing has a first closed end and a second open end, which fits over the end of a barrel of the gun and extends over the barrel a short distance. The opposite closed end of the bullet trap housing is filled with braking material, such as rubber compounds, to stop a bullet in the event of an accidental discharge. The bullet trap housing includes vent holes located between the end of the barrel and the braking material to permit the release of gases in the event of an accidental discharge.

23 Claims, 2 Drawing Sheets

10
11
12
14
16
18
20
22
24
26
27
30
36
38
40
41
42
43
50
51
52
54
56
58
59
60
62
64
68

WEAPON DISCHARGE SAFETY MECHANISM

BACKGROUND

Handguns are in widespread use, both by law enforcement agencies and by people who carry guns for their own protection. Inadvertent discharge of such handguns frequently occurs through mishandling of the gun in a casual manner by someone who is unaware that the gun is in firing condition (chamber loaded), or during loading and unloading of the gun. Devices have been designed to lock the trigger of a gun against inadvertent actuation. Such devices include safety locks built into the guns, as well as slide buttons in the rear of the trigger guard. Some devices employ locks with keys; and others are cumbersome and interfere with the holstering of a gun.

A trigger safety device designed particularly for blocking the trigger operation of a police revolver is disclosed in the U.S. Pat. No. 3,713,239 to Sperling. This device is a mechanical trigger block in the form of a plug made of resilient material, which is wedged behind the trigger between it and the trigger guard. The material is a medium-soft rubber or plastic material. When the plug is in place, it is compressed; so that it remains firmly in position. When the gun is to be used, it is necessary for the user to firmly push the plug out from behind the trigger to remove it so that the gun can be used. The resilient nature of the plug and the fact that it must be compressed to hold it in place causes removal of the plug, in an emergency situation, to be subject to potential failure. In addition, to ensure full complete removal of the plug, the index finger of the user must be pressed into the space behind the trigger. Modern firearms, in many cases, do not have a large enough space behind the trigger to fit a finger. A trigger block of this type also may be used to prevent accidental firing of the gun when it is either being loaded or unloaded. Because of the nature of the block, however, it is possible to accidentally move the trigger in such a manner to cause an inadvertent or accidental discharge of the gun.

Another safety lock, placed behind the trigger of a handgun between the trigger and the trigger guard, is disclosed in the U.S. Pat. No. 3,372,641 to Adajian. This patent presents some of the same problems as the device of the Sperling patent discussed above. In addition, the Adajian safety lock is complex and requires multiple parts and springs for its operation. The trigger lock of Adajian requires that the tip of the nail of the trigger finger engage an exposed front face of a spring-loaded catch to move it backward to allow the lock to drop free away from the handgun. Once again, the insertion and removal of this device from behind the trigger still subjects the user of the handgun to the possibility of an accidental discharge during loading or unloading of the handgun, since it is necessary to manipulate the device behind the trigger of the handgun in order to effect the blocking and release.

A more recent and more effective trigger lock safety device is disclosed in the U.S. Pat. No. 5,724,760 to Langner. This trigger safety lock comprises a rigid plug designed to frictionally fit into the space between the rear of the trigger of the gun and the trigger guard. The plug prevents depression of the trigger to fire the gun. Loading and unloading of the gun ideally is effected with the trigger block in place. If the trigger block accidentally should be removed during this process, or if the user should inadvertently move the trigger prior to the insertion of the trigger block, it is possible to accidentally misfire the gun prior to the installation of the trigger block, or after its removal, during the loading or unloading process.

Three other patents which are directed to quick release gun trigger safety devices are the U.S. Pat. Nos. 4,945,665; 5,033,218 and 5,371,965 to Nelson. All of these patents are directed to devices which require the trigger first to be pulled back against the trigger guard. This is a situation which normally, if the gun is cocked and loaded, causes a firing of the gun. The safety device (in the form of a plug) then goes in front of the trigger to prevent further operation of the firearm. The plugs of these patents are removed by pushing them out of the space between the trigger and the trigger guard. Even if such plugs are in place prior to the loading or unloading of the gun, the muzzle of the gun still is exposed; and if, for some reason, an accidental discharge should take place, a dangerous situation exists.

Many law enforcement agencies require officers to load and unload guns in a specified location, with the muzzle of the gun pointed toward a barrel of sand or the like. As a consequence, if an accidental discharge should take place during the loading or unloading of the gun, the bullet which is discharged should strike the barrel of sand and be stopped within a few inches; so that no harm is done. When firearms are loaded and unloaded in a law enforcement agency location in this manner, the sand barrel theoretically provides the desired level of safety. A possibility still exists, however, if an officer is distracted or somehow is jostled during the loading and unloading operation, the barrel of the handgun may not be pointed at the sand barrel. Thereby, in the event of an accidental discharge, the bullet may miss the sand. This creates a dangerous situation, even if the barrel is not pointed directly at a bystander, since ricocheting of the bullet or splintering of the bullet could create a dangerous situation for both personnel and the surroundings.

It is desirable to provide a simple and inexpensive device to absolutely guarantee safety during loading and unloading of a weapon in the event of an accidental discharge.

SUMMARY OF THE INVENTION

It is an object of this invention to provide an improved safety mechanism for a gun.

It is a further object of this invention to provide an improved weapon discharge safety mechanism for a gun.

It is an additional object of this invention to provide an improved discharge safety mechanism for a gun for use during the loading and unloading of the gun.

It is a further object of this invention to provide an improved weapon discharge safety mechanism for a gun which is attached to the gun during loading and unloading operation, which prevents use of the trigger, and which encases the muzzle with a discharge chamber; so that in the event of an accidental discharge, the bullet is stopped and captivated within the safety mechanism.

In accordance with a preferred embodiment of the invention, a weapon discharge safety mechanism is constructed of two primary parts. One part is a trigger guard housing which has a bottom and first and second spaced sides, with an open top. This trigger guard housing is dimensioned to fit over and cover the guard of a firearm. Aligned holes through the spaced sides receive a retention pin behind the front of the trigger guard to hold the trigger guard housing in place over the trigger guard during the loading and unloading of the gun. The second portion of the safety mechanism is a bullet trap housing, which has a closed end and an open end. The open end fits over and surrounds the end of the barrel of a firearm, with the housing surrounding the muzzle end of the firearm. For pistols or handguns, the trigger guard housing and the bullet trap housing are interconnected to form a unitary safety mechanism.

DETAILED DESCRIPTION

Figure 1:
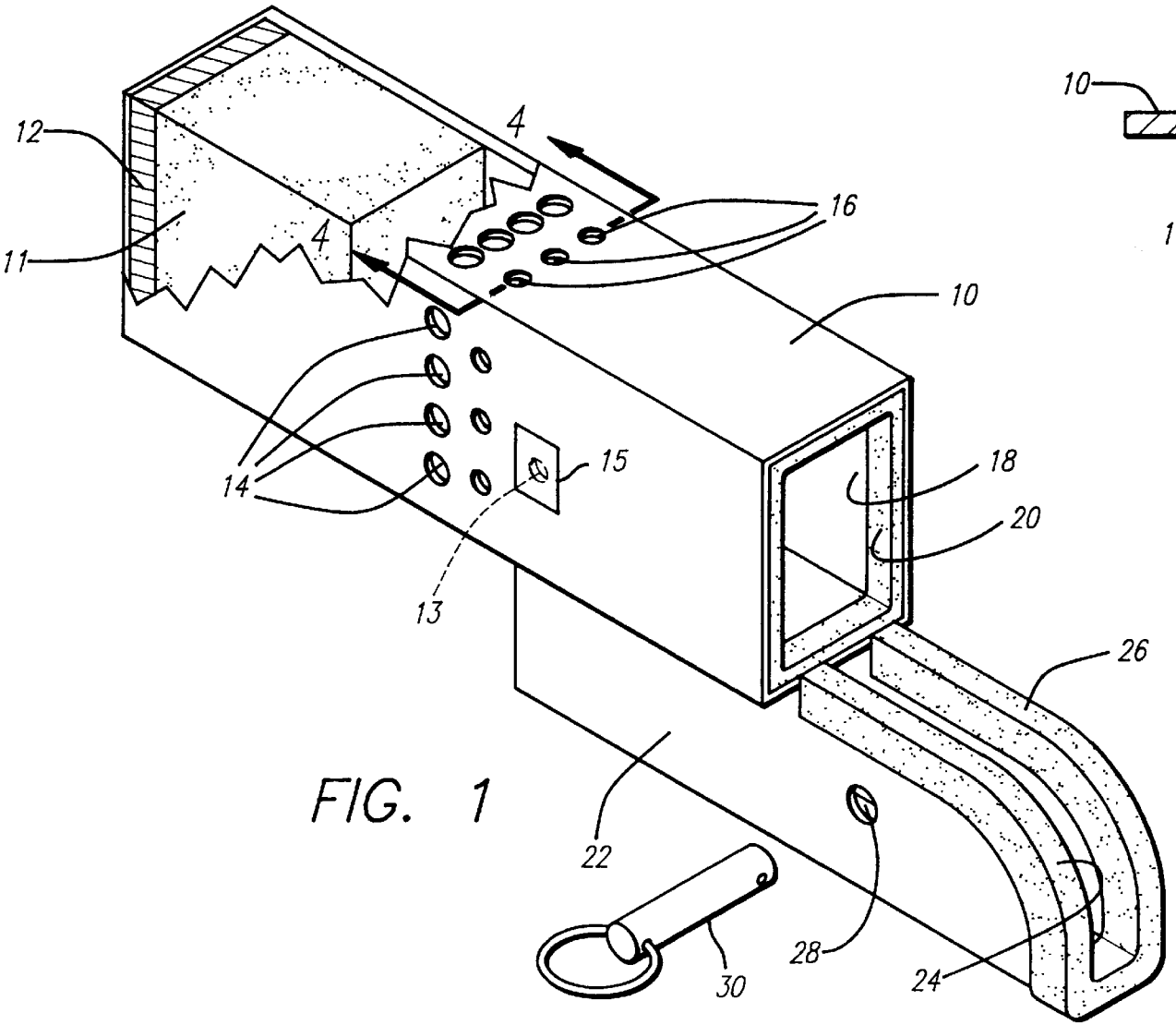
FIG. 1 is a partially cut away perspective view of a preferred embodiment of the invention.

Reference now should be made to the drawings, in which the same reference numbers are used throughout the different figures to designate the same components. FIG. 1 is a perspective view of a weapon discharge safety mechanism particularly designed for use with pistols or handguns. The safety mechanism comprises a bullet trap in the form of an elongated rectangular or tubular housing 10, preferably made of steel or similar material, which is closed at its left-hand end, as viewed in FIGS. 1 and 2, with a steel plate (or plate made of other suitable material) 12. The right-hand end of the housing 10, as viewed in FIGS. 1 and 2, has an opening 18 through it to accommodate the muzzle end of the barrel 36 of a handgun, as shown most clearly in FIG. 2.

Figures 2, 3, 5, 6:
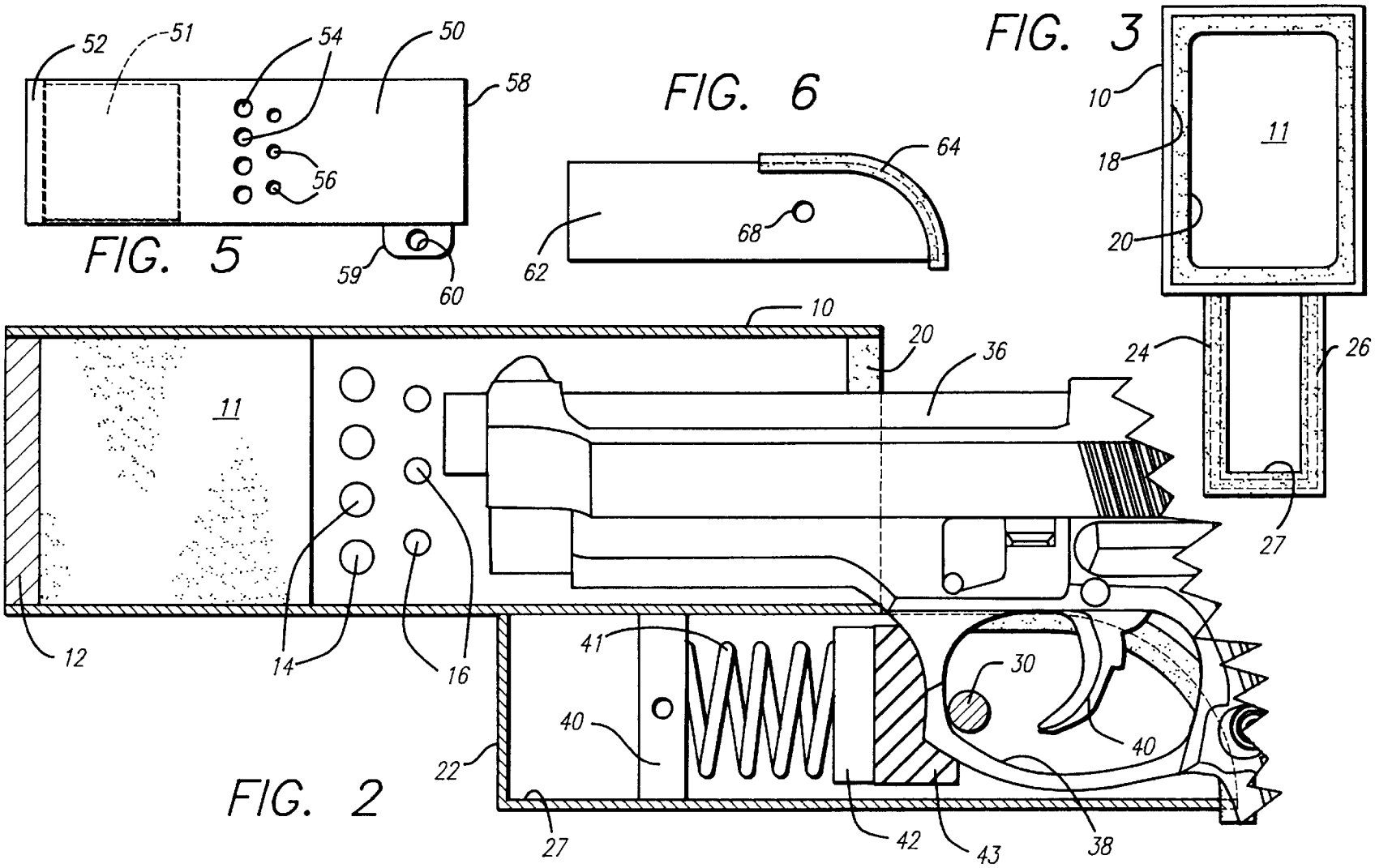
FIG. 2 is a cross-sectional view of the embodiment of FIG. 1 showing its manner of use in conjunction with a firearm.
FIG. 3 is an end view of the embodiment shown in FIG. 1.
FIG. 5 is a side view of an alternative embodiment of the invention.
FIG. 6 is a side view of another portion of the alternative embodiment of the invention.

A bullet braking or shock absorbing block 11, made of rubber compound or other containment material, such as armor or crushable honeycomb, is placed in or molded into the left-hand end of the housing 10 as shown in FIGS. 1 and 2. The bullet braking material 11 abuts the end plate 12, and is spaced from the discharge end or muzzle end of the barrel 36 of a handgun inserted into the device. The material 11 ideally is a specific rubber compound having a Durometer hardness range, Shore A: 70–85. This stops the bullet with a braking action to prevent injury to a person in the event of a discharge. The steel plate 12 typically is 0.250 inches thick and is welded to the end of the housing 10 to further contain the projectile or bullet in case it completely penetrates the compound 11. This is a highly unlikely situation; but the steel plate 12, alone, is designed to be strong enough to withstand any known handgun projectile which might be fired at it through the housing 10 and material 11.

In the region of the housing 10, which is located between the end of the barrel 36 of a handgun (FIG. 2) and the right-hand end of the bullet stopping or bullet braking material 11, a number of gas vent holes 14 and 16 are formed along the sides and top, as illustrated in FIGS. 1 and 2. An additional vent hole 13 (see FIG. 1) is formed through the housing 10 and has a thin adhesive-backed foil indicator label 15 covering it. In the event that a discharge should take place when the device is in the position shown in FIG. 2, the expanding gases within the interior of the housing 10 will blow a hole through the indicator foil 15, clearly indicating that a discharge has occurred. Since the force of such a discharge may, in some cases, distort the housing 10 and since a bullet or projectile is embedded in the material 11, the device should be replaced or remanufactured. The indicator hole 13 and foil 15 permit a positive indication to potential subsequent users that a discharge in fact has taken place and that the device should be replaced.

In order to effectively utilize the bullet trap portion 10, however, it is necessary to secure the bullet trap 10 to the firearm during the loading and unloading operation. To accomplish this, a trigger guard housing 22 having a pair of side plates 24 and 26, a bottom 27, and a closed end is welded to the bottom of the housing 10 to extend to the right (as shown in FIGS. 1 and 2) beyond the open end 18 of the bullet trap housing 10. The upper edges of the side plates 24 and 26 are curved and are covered with resilient or padded edges to fit and conform over the trigger guard of a handgun or pistol to abut the region above the trigger guard where the trigger is located and at the rear where the grip of the handgun is located.

The device is placed on a handgun by sliding the open end 18 of the housing 10 over the barrel 36; so that a resilient pad 20, which is located around the interior of the open end 18, is adjacent the barrel of the handgun as shown most clearly in FIG. 2. The slot formed by the upper open edge of the trigger guard housing between the sides 24 and 26 then is slid past the trigger guard 38 to the position shown in FIG. 2.

Once the trigger guard is in place as shown in FIG. 2, a locking device in the form of a retention pin 30, or a padlock, is inserted through a pair of aligned spaced holes 28 located in the sides 24 and 26 to a location which is just behind the front of the trigger guard 38, as shown most clearly in FIG. 2.

Although it is not necessary for the operation of the device, it may be desirable to provide a spring bias mechanism to securely locate the pin 30 against the inside of the front of the trigger guard 38 by means of a block 40, a compression spring 41, a plate 42, and a resilient pad 43; so that as the device is moved from left to right to the position shown in FIG. 2, the pad 43 engages the outer front side of the trigger guard 38 to press against the spring 41 when the device is held in place against the front of the trigger guard 38 by the pad 43. This also ensures that when the pin 30 or a padlock is removed from the holes 28 in the side panels 24 and 26, the device is forced toward the left (as viewed in FIG. 2) by the action of the spring to facilitate its removal from the pistol.

In operation, once the device is secured in place as shown in FIG. 2, loading and unloading of the handgun may be effected. First of all, it is obvious from an examination of FIGS. 1 and 2, no access to the trigger 40 located within the trigger guard 38 is possible. The side plates 24 and 26 of the trigger guard housing 22 completely cover all of the openings between the trigger guard 38 and the trigger 40; so that no access from either side is possible. The pin 30 holds the entire assembly in place, locked onto the handgun, and prevents any accidental removal. If for any reason a discharge of the handgun should take place during the loading and unloading operation, the bullet exiting from the discharge or muzzle end of the barrel 36 passes from the end of the barrel through the space where the vents 14 and 16 are located, and enters into the rubber or other braking material 11. The dimensions which are shown in FIG. 2 are actual proportions. The entire device is on the order of 7 or 8 inches long, and just sufficiently wide enough and tall enough to accommodate the barrel 36 of the handgun with which it is being used. If a discharge takes place, there is no recoil, since the forces of the bullet striking the braking material or bullet stopping material 11 are counteracted by the recoil forces applied to the barrel. Everything is held in place by the retention pin 30, even though a complete discharge has taken place. Since the bullet is completely trapped in the material 11, the orientation of the handgun during an accidental discharge is irrelevant. No harm can take place, due to the fact that the bullet is trapped entirely within the bullet trap housing 10. Accidental discharges, by the way, are highly unlikely with a device of this type, since generally accidental discharges are brought about by an inadvertent operation of the trigger 40 during the loading and unloading operation. Because the trigger 40 is completely covered by the trigger guard housing 22 during loading and unloading with the device shown in FIGS. 1 and 2, discharges rarely ever will take place. If one does occur, however, the vent holes 14 and 16 are sufficient to allow the escape of the expanding gases; and no harm is done.

Figure 4:
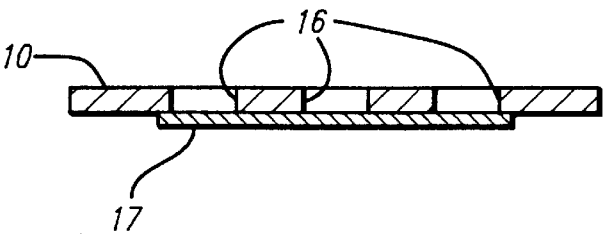
FIG. 4 is a cross-sectional view of a portion of the embodiment shown in FIG. 1 taken along the line 4—4 of FIG. 1.

FIG. 3 is an end view which illustrates the orientation of the various parts. This figure clearly shows the relative sizes and dimensions of the bullet trap housing 10 and the trigger guard housing 22. FIG. 4 is a cross-sectional view taken along the line 4—4 of FIG. 1, and illustrates another variation which may be used in place of the vent hole 13 covered by the foil 15 described previously. As shown in FIG. 4, a thin strip of adhesive-backed foil 17 may be placed across the three holes 16 in the top of the device 10. In the event of an accidental discharge, the escaping gases will rupture the membrane 17 in the region of the holes 16 and provide a positive indication that a bullet has been discharged in the device. This indication can be effected in the same manner as the indication described previously in conjunction with the separate covered vent hole.

FIGS. 5 and 6 illustrate an alternative embodiment of the invention which may be used in conjunction with rifles, where the trigger is located at a greater distance from the muzzle or exit end of the barrel than is the case with handguns described in conjunction with the embodiment of FIGS. 1, 2 and 3. Consequently, for use with a rifle, the device which has been shown in conjunction with FIGS. 1, 2 and 3 may be separated into two separate parts. In place of the trigger guard housing 22, a trigger guard housing 62, which is essentially identical in all respects to the housing 22, is provided. The housing 62 has a pair of spaced side walls 64 and 66 (66 not shown), comparable to the side walls 24 and 26. A pair of aligned holes 68 passing through the sides for accommodating a locking pin or padlock in the same manner described above in conjunction with the device shown in FIGS. 1 and 2. Thus, the portion shown in FIG. 6 comprises a trigger guard housing 62 which, when it is in place, completely covers the trigger and trigger guard of a rifle or other firearm in the same manner as described above in conjunction with the embodiment of FIGS. 1, 2 and 3.

To complete the device for use with rifles, the bullet trap housing is made as a separate unit 50, which is constructed in accordance with the same general dimensions of the housing 10 described above in conjunction with FIGS. 1 and 2. The housing 50 includes an end steel plate 52, which is welded into the left-hand or distal end from the end of the barrel. The plate 52 has a bullet-stopping material 51 placed against it in the left-hand end as viewed in FIG. 5 of the bullet trap housing 50. Vent holes 54 and 56 are provided around the sides and top of the device shown in FIG. 5; and it has an open end 58, which is comparable to the open end 18 of the device described above in conjunction with FIGS. 1 and 2. In addition, however, the device of FIG. 5 includes a downwardly depending connection ear 59 with a hole 60 through it; so that it may be used to engage a bayonet clip or a similar clip located near the end of the barrel on the rifle with which the device is to be used. When both the devices of FIGS. 5 and 6 are secured in place by retention pins or padlocks, the safety operation, which has been described above in conjunction with a handgun, also is effected for use with a rifle.

Mention has been made in the previous description of the use of a padlock in place of the pin 30. Clearly, whenever a padlock is used to replace the retention pin 30, the weapon is securely locked; so that accidental discharge by children or unauthorized users of the handgun cannot take place in a manner where any harm could be done, since the end of the barrel, as well as the trigger, are fully protected by this weapon safety discharge mechanism. Consequently, a greater degree of safety exists than is effected by means of a trigger lock by itself.

It should be noted that multiple units, mounted adjacent one another, can be used in law enforcement agencies to replace the need for gun lockers, in addition to providing the safety features listed above. The device also may be mounted in a permanent location on a permanent mounting rack or on a portable stand, if desired, for use at a specific location to facilitate the loading and unloading of a firearm.

The foregoing description of the preferred embodiment of the invention should be considered as illustrative, and not as limiting. Various changes and modifications will occur to those skilled in the art to perform substantially the same function, in substantially the same way, to achieve substantially the same result, without departing from the true scope of the appended claims.

What is claimed is:

1. A weapon discharge safety mechanism including in combination:

a trigger guard housing portion having a bottom, first and second sides and an open top dimensioned to fit over and cover a trigger guard of a firearm, said trigger guard housing portion having aligned holes in said first and second sides to receive a retention pin behind the front of a trigger guard for holding said trigger guard housing portion in place; and a bullet trap enclosed housing portion adapted to be releasably secured to a firearm, with first and second ends, said first end being closed and said second end open to fit over and surround the end of a barrel of a firearm.

2. The combination according to claim 1 wherein said bullet trap housing includes vent holes located in the region adjacent the end of a barrel of a firearm when said housing is in place surrounding the end of such barrel.

3. The combination according to claim 2 wherein said bullet trap housing portion further includes bullet braking material filling said first end and spaced from the end of a barrel when said bullet trap housing portion is in place over and surrounding the barrel of a firearm.

4. The combination according to claim 3 wherein said bullet trap housing portion is made of steel.

5. The combination according to claim 4 further including a rupturable seal covering at least one of said vent holes, whereupon said seal is ruptured whenever a firearm is discharged with said bullet trap housing portion in place over and covering the end of a barrel of a firearm.

6. The combination according to claim 5 wherein said rupturable seal comprises adhesive foil.

7. The combination according to claim 6 wherein said bullet braking material comprises a rubber-like compound.

8. The combination according to claim 7 wherein said trigger guard housing portion further includes a spring-biased pad located between the first and second sides thereof for engagement with the front of a trigger guard when said trigger guard housing portion is moved into place to cover a trigger guard.

9. The combination according to claim 8 wherein said bullet trap housing portion is permanently attached to said trigger guard housing portion.

10. The combination according to claim 1 wherein said bullet trap housing portion further includes bullet braking material filling said first end and spaced from the end of a barrel when said bullet trap housing portion is in place over and surrounding the barrel of a firearm.

11. The combination according to claim 10 wherein said bullet braking material comprises a rubber-like compound.

12. The combination according to claim 11 wherein said bullet trap housing portion is made of steel.

13. The combination according to claim 2 further including a rupturable seal covering at least one of said vent holes, whereupon said seal is ruptured whenever a firearm is discharged with said bullet trap housing portion in place over and covering the end of a barrel of a firearm.

14. The combination according to claim 13 wherein said rupturable seal comprises adhesive foil.

15. The combination according to claim 14 wherein said bullet trap housing portion is permanently attached to said trigger guard housing portion.

16. The combination according to claim 15 wherein said trigger guard housing portion further includes a spring-biased pad located between the first and second sides thereof for engagement with the front of a trigger guard when said trigger guard housing portion is moved into place to cover a trigger guard.

17. The combination according to claim 10 wherein said bullet braking material comprises a rubber-like compound.

18. The combination according to claim 17 wherein said trigger guard housing portion further includes a spring-biased pad located between the first and second sides thereof for engagement with the front of a trigger guard when said trigger guard housing portion is moved into place to cover a trigger guard.

19. A self-contained weapon discharge safety mechanism including in combination:

a trigger guard housing portion having a bottom, first and second sides and an open top dimensioned to fit over and cover a trigger guard of a firearm, said trigger guard housing portion having aligned holes through the first and second sides thereof to receive a removable retention pin behind the front of a trigger guard to hold said trigger guard housing portion in place covering a trigger guard; and a bullet trap enclosed housing portion secured to said trigger guard housing portion and offset therefrom, said bullet trap housing portion having a first closed end and a second open end whereby said second open end is dimensioned to fit over and enable said bullet trap housing portion to enclose the end of a barrel of a firearm when said trigger guard housing portion is in place to cover the trigger guard of a firearm, such that said bullet trap enclosed housing portion surrounds and covers the end of the barrel of a firearm.

20. The combination according to claim 19 wherein said bullet trap housing includes vent holes located in the region adjacent the end of a barrel of a firearm when said housing is in place surrounding the end of such barrel.

21. The combination according to claim 20 wherein said bullet trap housing portion further includes bullet braking material filling said first end and spaced from the end of a barrel when said bullet trap housing portion is in place over and surrounding the barrel of a firearm.

22. The combination according to claim 21 wherein said bullet braking material comprises a rubber-like compound.

23. The combination according to claim 19 wherein said bullet trap housing portion is made of steel.

* * * * *